United States Patent [19]

Exner

[11] Patent Number: 4,496,636

[45] Date of Patent: Jan. 29, 1985

[54] PROCESS FOR DEPOSITING A COAT OF PAINT ON WOOD-CEMENT BOARDS

[75] Inventor: Günter Exner, Dettelbach, Fed. Rep. of Germany

[73] Assignee: Fulgurit GmbH & Co. Kommanditgesellschaft, Wunstorf, Fed. Rep. of Germany

[21] Appl. No.: 409,135

[22] Filed: Aug. 18, 1982

[30] Foreign Application Priority Data

Aug. 27, 1981 [DE] Fed. Rep. of Germany ..... 3133974

[51] Int. Cl.[3] ..... D04H 1/16; B05D 1/00

[52] U.S. Cl. ..... 428/703; 118/244; 264/109; 264/113; 264/122; 427/209

[58] Field of Search ..... 264/109, 113, 122; 427/369, 393, 393.6, 209; 428/703; 118/244

[56] References Cited

U.S. PATENT DOCUMENTS

| | | | |
|---|---|---|---|
| 3,207,819 | 9/1965 | Raddin et al. | 264/109 X |
| 3,210,212 | 10/1965 | Carson et al. | 427/393.6 |
| 3,287,479 | 11/1966 | Naudain | 264/109 X |
| 3,403,205 | 9/1968 | Ottenholm | 264/109 |
| 3,419,461 | 12/1968 | Gebhard et al. | 427/393.6 |

*Primary Examiner*—Michael R. Lusignan
*Attorney, Agent, or Firm*—Wells & Wells

[57] ABSTRACT

In a process for depositing a coat of paint on wood-cement boards manufactured by pouring a strewable mixture of fibers and binder onto press plates and then stack-pressing, with a coat of paint being applied to the board surface after pressing, the board shall be provided with a coat of paint of extremely long life approximately corresponding to the life of the board. This problem is solved by the invention in that a binder liquid colored-through with an inorganic dye is deposited on the layer of the strewable layer poured on the press plate and that the press plate together with the layers so deposited is fed to the press.

15 Claims, 2 Drawing Figures

PROCESS FOR DEPOSITING A COAT OF PAINT ON WOOD-CEMENT BOARDS

BACKGROUND OF THE INVENTION

The invention concerns a process for depositing a coat of paint on wood-cement boards manufactured by pouring a strewable mixture of fibers and binder on pressing plates and then pressing into stacks, the pressing being followed by depositing paint on the board surface.

The board can be either without a coat of paint or else be provided with integral dyeing from an additive to the strewable mixture.

A drawback is incurred in this procedure in that especially where such boards are used externally, the coat of paint deposited after pressing will flake off again in the course of time because of inadequate adhesion to the wood fibers of the wood-cement board.

As regards the integrally dyed boards, a coloring will remain even after the additionally deposited layer of paint has flaked off, but there is a drawback in this case that following the flaking-off of the coat of paint, the cement will bloom because of its lime, and the boards become unsightly.

These drawbacks become especially perceptible in extreme weather and in particular with respect to roof-covering boards.

SUMMARY OF THE INVENTION

It is therefore the object of the invention to provide a wood-cement board of the initially cited type with a coat of paint which is extremely durable and the life of which corresponds to the life of the board.

This problem is solved by the invention by depositing a binder liquid on the layer of the strewable mixture of fibers and binder that was poured on the pressing plate, said binder liquid being colored-through with an inorganic dye, and in that the press plate together with the layers so deposited is fed to the press.

Thus it was surprisingly found that despite the liquid above the poured material the layers so formed can be pressed in problem-free manner without thereby incurring adhesions to the force and/or to the press plate.

Accordingly the process of the invention achieves that the coloring can be integrated into the process without additional operational steps, and surprisingly despite the deposition of a liquid mixture of dye and binder no additional dehydration is required. The process operates without excess of water and therefore is basically wholly unaffected in its principle by the paint deposition of the invention.

Because a mixture of dye and binder is used that contains no fibers at all, the wood-cement layer is simultaneously covered with respect to the outside, whereby a problem-free adhesion base is provided for the coloring that follows pressing.

For the same reason the paint cannot flake off as it does in the boards made by the known methods, as no bond is provided between the wood fibers and the subsequently deposited coat of paint.

The liquid provided by the invention in the mixture of dye and bonding agent is required to assure a problem-free deposition of this mixture on the poured material.

As shown by tests, deposition without an excess of water, that is, in the strewable state of the binder, is impossible, as clumping would result and hence even deposition would not be assured. Therefore and surprisingly, uniform deposition was possible only in the liquid state.

The process of the invention offers another advantage, namely that as a result of the liquid-state deposition, the binder so firmly achors into the poured bulk layer that no subsequent loosening is possible at all because of the different coefficients of expansion between on one hand the colored and fiber-free layer of the binder and on the other hand the wood-cement layer.

Thus further tests have shown that when the layer of dye and binder is deposited in the strewable state, this layer—due to the above cited circumstances—can again detach from the substrate after the pressing procedure.

The invention offers another solution, namely that before strewing the mixture of fibers and binder, a binder liquid is deposited on the press plate, said liquid being colored through by an inorganic dye, and in that the press plate together with the layers deposited is fed to the press.

In this manner it is also possible to provide that side of the future wood-cement board which faces the press plate with a coat of paint or with an adhesion base for a coat of paint. It is possible to use both steps simultaneously for purposes of bilateral coloring.

The binder for the mixture of dye and binder besides being cement can be another hydraulic binder such as trass, i.e. a pumice powder.

The binder also can be a combination of cement and trass.

Advantageously the mixture of dye and binder is deposited using an apparatus with a brush-roller revolving within a container holding the liquid mixture of dye and binder, said brush-roller centrifuging the mixture of dye and binder out of the container. This brush-roller and its container may be arranged in a housing with baffle-plates guiding the liquid mixture of dye and binder onto the surface of the strewn bulk layer, i.e. the surface of the press plates.

BRIEF DESCRIPTION OF THE DRAWINGS

The invention is discussed in closer detail below in relation to illustrative embodiments shown in the drawings.

DESCRIPTION OF THE PREFERRED EMBODIMENTS

Figure 1:
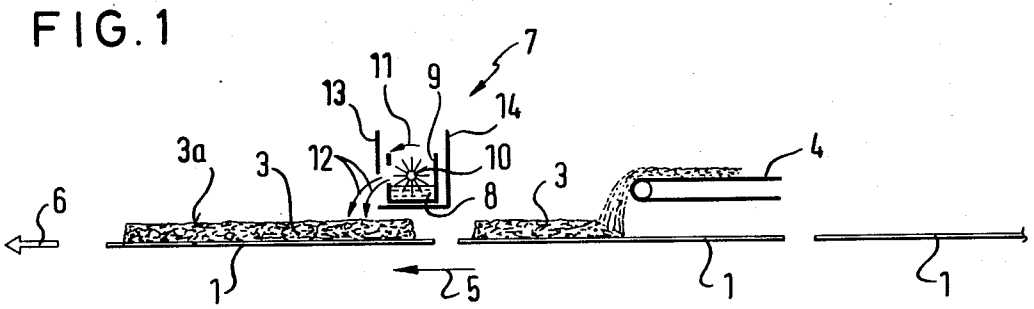
FIG. 1 schematically shows the process sequence for one embodiment of the invention.

As shown in FIG. 1, a layer 3 of a strewable mixture of fibers and binder is poured from a belt 4 or the like onto the prss plate 1. The press plates 1 move in the direction of the arrow 5 and, as indicated by arrow 6, are then fed to a stacking press (omitted).

In the embodiment of FIG. 1, a liquid mixture 8 of dye and binder is deposited on the top side of the layer 3, said mixture 8 being held in a container 9 within which a brush-roller 10 revolves in the direction of the arrow 11 and centrifuges the liquid mixture of dye and binder through an aperture in the container wall in the direction of the arrows 12 against the strewn layer 3. Additionally baffle plates 13 and 14 are provided to assure that the liquid mixture of dye and binder be guided toward the strewn layer 3.

The liquid mixture of dye and binder is thusly deposited on the top side of the poured layer 3 where initially the liquid remains. Nevertheless and surprisingly the layer 3 when in this state can be pressed into a board when in the stack.

Figure 2:
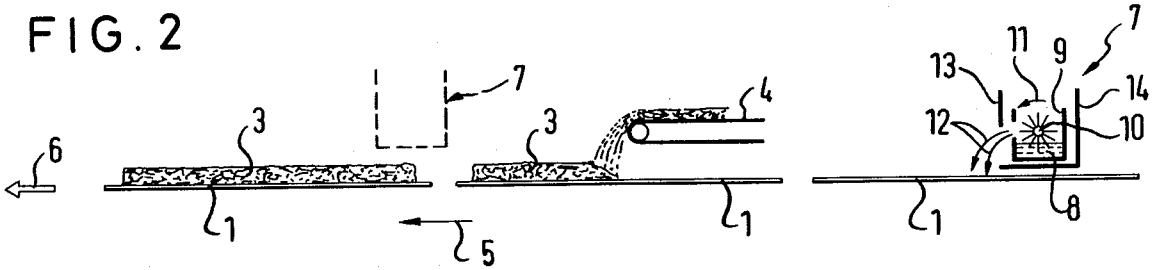
FIG. 2 is an embodiment similar to but modified from that shown in FIG. 1.

The same equipment described above is used for the embodiment of FIG. 2 to deposit the liquid mixture of dye and binder prior to pouring the layer 3. Accordingly the layer 3 is strewn onto the liquid on the press plate 1. In this manner the side of the future wood-cement board facing the press plate 1 is dyed and also provided with an adhesion base for a coat of paint.

As indicated by the dashed lines, it is possible in addition to use the equipment 7 of FIG. 1 to further provide the top side of the future wood-cement board with a coat of paint, whereby the future board is or can be colored on both sides.

I claim:

1. In a process for depositing a coat of paint on wood-cement boards manufactured by pouring a strewable mixture of fibers and binder onto press plates followed by pressing the plates in a stack, the board surface after pressing having a base for applying said coat of paint upon which said coat of paint is applied, the improvement comprising:

depositing binder liquid on an upper layer of said strewable mixture of fibers and binder, said binder liquid being colored through with an inorganic dye, and in that the press plate together with the layers so deposited is fed to a press for said pressing, said base for applying said coat of paint comprising said binder liquid colored through with said inorganic dye.

2. In a process for depositing a coat of paint on wood-cement boards manufactured by pouring a strewable mixture of fibers and binder onto press plates followed by pressing the plates in a stack, the board surface after pressing having a base for applying said coat of paint upon which said coat of paint is applied, the improvement comprising:

depositing binder liquid on the press plate prior to pouring said strewable mixture of fibers and binder, said binder liquid being colored through with an inorganic dye, and in that the press plate together with the layers so deposited is fed to a press for said pressing, said base for applying said coat of paint comprising said binder liquid colored through with said inorganic dye.

3. In a process for depositing coats of paint on the top and bottom surfaces of wood-cement boards manufactured by pouring a strewable mixture of fibers and binder onto press plates followed by pressing the plates in a stack, the top and bottom surfaces after pressing each having a base for applying said coat of paint upon which said coats of paint are applied, the improvement comprising:

(a) depositing first binder liquid on the press plate prior to pouring said strewable mixture of fibers and binder, said first binder liquid being colored through with an inorganic dye;

(b) depositing said strewable mixture on said first binder liquid; and (c) depositing a second binder liquid on an upper layer of said strewable mixture of fibers and binder, said second binder liquid being colored through with an inorganic dye, and in that the press plate together with the layers so deposited is fed to a press for said pressing, said bases for applying said coats of paint comprising said binder liquid colored through with said inorganic dye.

4. The process of claim 1, wherein said binder is a cement hydraulic binder.

5. The process of claim 2, wherein said binder is a cement hydraulic binder.

6. The process of claim 3, wherein said binder is a cement hydraulic binder.

7. The process of claim 1, wherein said binder is trass hydraulic binder.

8. The process of claim 2, wherein said binder is trass hydraulic binder.

9. The process of claim 3, wherein said binder is trass hydraulic binder.

10. The process of claim 1, wherein said binder is a combination of cement and trass.

11. The process of claim 2, wherein said binder is a combination of cement and trass.

12. The process of claim 3, wherein said binder is a combination of cement and trass.

13. The product produced by the process of claim 1.

14. The product produced by the process of claim 2.

15. The product produced by the process of claim 3.

* * * * *